US008833747B2

(12) United States Patent
Cusumano

(10) Patent No.: US 8,833,747 B2
(45) Date of Patent: Sep. 16, 2014

(54) HOLDER FOR FRAMING MEMBERS AND METHOD OF USE

(75) Inventor: Procopio Cusumano, Monroe, MI (US)

(73) Assignee: Truss Setter, LLC, Rochester Hills, MI (US)

( * ) Notice: Subject to any disclaimer, the term of this patent is extended or adjusted under 35 U.S.C. 154(b) by 457 days.

(21) Appl. No.: 13/211,374

(22) Filed: Aug. 17, 2011

(65) Prior Publication Data

US 2012/0043709 A1 Feb. 23, 2012

Related U.S. Application Data

(60) Provisional application No. 61/374,353, filed on Aug. 17, 2010.

(51) Int. Cl.

| | |
|---|---|
| ***B25B 1/20*** | (2006.01) |
| ***B25B 1/02*** | (2006.01) |
| ***B25B 5/02*** | (2006.01) |
| ***B25B 5/16*** | (2006.01) |
| ***B25B 5/12*** | (2006.01) |
| ***B25B 5/00*** | (2006.01) |

(52) U.S. Cl.

CPC ..... *B25B 5/127* (2013.01); *B25B 5/163* (2013.01); *B25B 5/003* (2013.01)

USPC ..... 269/43; 269/45; 269/176; 269/143

(58) Field of Classification Search

CPC ..... B25B 5/00; B25B 1/00

USPC ..... 269/43, 45, 143, 249, 166, 176; 29/270, 29/276

See application file for complete search history.

(56) References Cited

U.S. PATENT DOCUMENTS 6,896,249 B1 * 5/2005 Ferrara ..... 269/154

* cited by examiner

*Primary Examiner* — Lee D Wilson
*Assistant Examiner* — Seahee Yoon
(74) *Attorney, Agent, or Firm* — Gifford, Krass, Sprinkle, Anderson & Citkowski, P.C.; Douglas L. Wathen

(57) ABSTRACT

A tool for spacing and holding a first framing member relative to a second framing member has a first bar and a second bar that are slidably interconnected. A first stop and a second stop are connected to the first bar and a first and second counter-stop are connected to the second bar. The first stop and first counter-stop form a first jaw and the second stop and the second counter-stop form a second jaw. A mechanism is provided for moving the second bar relative to the first bar. Movement of the handle from an open position to a closed position moves the first and second jaws from the open position to the closed position.

10 Claims, 4 Drawing Sheets

HOLDER FOR FRAMING MEMBERS AND METHOD OF USE

REFERENCE TO RELATED APPLICATION

This application claims priority from U.S. Provisional Patent Application Ser. No. 61/374,353, filed Aug. 17, 2010, the entire content of which is incorporated herein by reference.

FIELD OF THE INVENTION

The present invention relates to a holder for framing members, such as trusses, joists and/or studs for walls, and a method of using the holder for holding, bracing and spacing the members.

BACKGROUND OF THE INVENTION

Those skilled in the art of setting roof trusses, floor joists and/or studs in walls, collectively herein referred to as framing members, appreciate that it can be difficult to secure such framing members to a structure while holding onto the framing member and a nail gun or hammer while also maintaining one's balance on the structure and while also keeping the framing member in the correct orientation and position.

Various devices exist for at least temporarily securing a frame member in place or locating it in a predetermined location until it can be permanently secured. Such devices, however, often lack portability, the ability to accommodate a wide variety of framing members and distances, they cannot be re-used, they are difficult to use and/or they are expensive.

The following describes a device that is highly portable, adjustable to a wide variety of framing members and applications, re-usable, easy to use and relatively inexpensive.

SUMMARY OF THE INVENTION

The present invention provides a tool for spacing and holding a first framing member relative to a second framing member at a predetermined distance. The tool has an elongated first bar having a first end portion and an opposed second end portion. The first bar has a bottom surface and an opposed upper surface. A first stop is interconnected with the first end portion of the first bar and extends downwardly beyond the bottom surface of the first bar. The first stop has an inwardly facing surface. A second stop is interconnected with the second end portion of the first bar and extends downwardly beyond the bottom surface of the first bar. The second stop has an outwardly facing surface. An elongated second bar has a first end portion and an opposed second end portion, and a bottom surface and an opposed upper surface. A first counter-stop is interconnected with the first end portion of the second bar and extends downwardly beyond the bottom surface of the second bar. The first counter stop has an outwardly facing surface. A second counter-stop is interconnected with the second end portion of the second bar and extends downwardly beyond the bottom surface of the second bar. The second counter-stop has an inwardly facing surface.

The first bar and the second bar are slidably interconnected such that the second bar is longitudinally movable with respect to the first bar and such that the inwardly facing surface of the first stop is directed toward and spaced from the outwardly facing surface of the first counter-stop and the outwardly facing surface of the second stop is directed toward and spaced from the inwardly facing surface of the second counter-stop. The first stop and the corresponding first counter-stop define a first jaw and the second stop and corresponding second counter-stop define a second jaw. The first jaw and the second jaw each have an open position and a closed position, the stops and corresponding counter-stops being spaced further apart in the open position than in the closed position. A mechanism is provided for moving the second bar relative to the first bar, the mechanism including a handle that is pivotally interconnected with one of the bars and a link having a first end pivotally interconnected with the handle and a second end pivotally interconnected with the other of the bars. Movement of the handle from an open position to a closed position moves the first and second jaws from the open position to the closed position.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined herein. Hence, specific dimensions, directions or other physical characteristics relating to the embodiments disclosed are not to be considered as limiting, unless expressly stated otherwise. However, the figures are scale drawings for certain, but not all, embodiments and measurements taken from the drawings provide additional disclosure for these particular embodiments.

Figure 1:
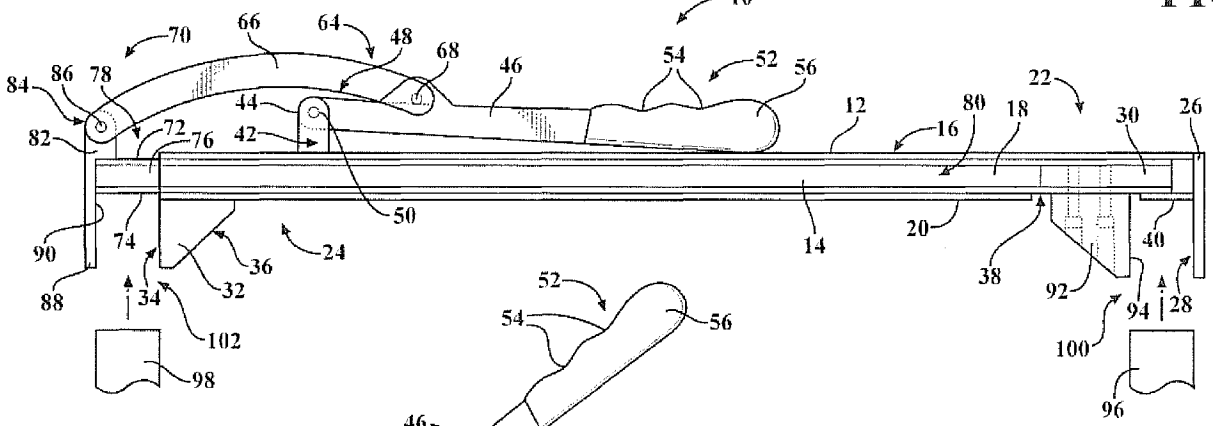
FIG. 1 is a cut-away side view of one embodiment of a holder where a handle portion of the holder is in a lowered or closed position.
Figure 2:
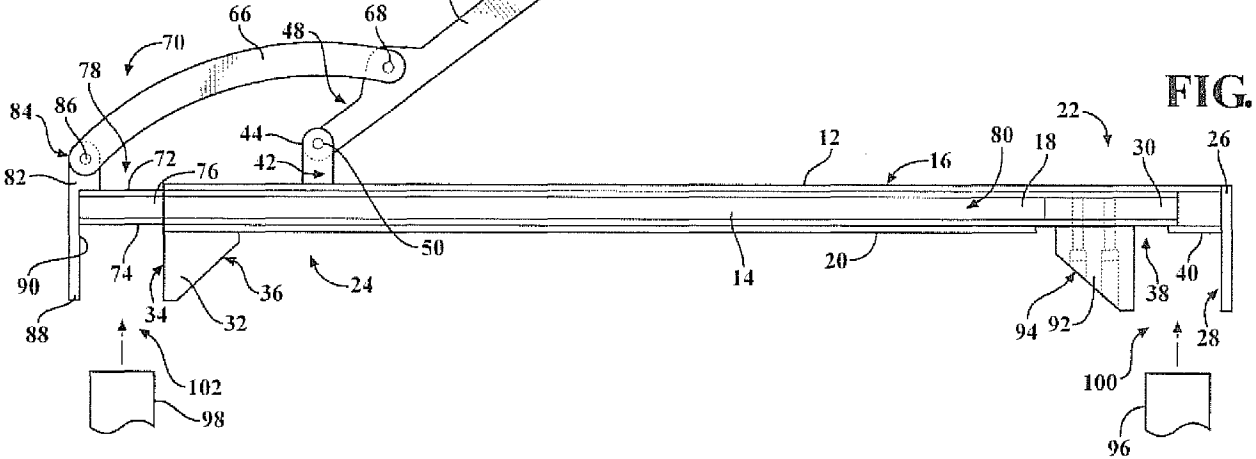
FIG. 2 is a cut-away side view of the holder of FIG. 1 where the handle portion of the holder is in a raised or open position.

Referring now to FIGS. 1 and 2, one embodiment of a holder 10 is depicted. The holder 10 comprises a first bar 12 and a second bar 14. The first bar 12 and the second bar 14 can be any length and any shape. As can be appreciated from the figures, the bars 12, 14 may both have a substantially square cross-section. Alternatively, the cross-section of either bar 12 or 14 may be square, rectangular, or any other polygon, in addition to being oval or round. In the depicted embodiment, the first bar 12 has an upper surface 16, two side surfaces 18, a bottom surface 20, a first end portion 22 and a second end portion 24

A first stop 26 is fixedly secured in or adjacent the first end portion 22 of the first bar 12. The first stop 26 depends downwardly from the first end portion 22 beyond the bottom surface 20 of the first bar 12. The stop 26 may be substantially rectangular in shape, with at least an inwardly facing surface 28 being substantially planar. The first stop 26 may be fixedly secured adjacent the first end portion 22 of the first bar 12 by any means including, but not limited to, welding, mechanical fasteners and/or adhesive.

The first bar 12 has a substantially hollow interior portion 30 along its entire length. The first stop 26 described above closes the first end portion 22. The second end portion 24, opposite the first end portion 22, is preferably open.

On the bottom surface 20 of first bar 12, adjacent or in the second end portion 24, a second stop 32 is fixedly attached. The second stop 32 may be fixedly secured adjacent or in the second end portion 24 of the first bar 12 by any means including, but not limited to, welding, mechanical fasteners and/or adhesive.

As shown the figures, the second stop 32 has a substantially planar outwardly facing surface 34. The outwardly facing surface 34 may be supported by any structure including a ramp-like structure 36 as shown in the figures.

On the bottom surface 20 of the first bar 12, adjacent or in the first end portion 22, a first window 38 is provided. The first window 38 may be any length and any width. The first window 38 may be separated from the first stop 26 by a gap 40, as shown in the figures. Alternatively, the holder 10 can work without the gap 40.

The holder 10 includes a mechanism for moving the first bar 12 and second bar 14 relative to one another. In the embodiment of FIGS. 1 and 2, this mechanism includes a handle 46 and a link 66 that define a linkage interconnecting the first bar and second bar. The mechanism may take other forms than illustrated.

The mechanism illustrated in FIGS. 1 and 2 will now be described in more detail. On the upper surface 16 of the first bar 12, adjacent or in the second end portion 24, a bracket 42 is provided. The bracket 42 may be comprised of two, substantially parallel upstanding portions 44. The bracket 42 pivotally mounts therein the handle 46. While one embodiment of the bracket 42 is depicted and described herein, other brackets that allow the handle 46 to pivot are permissible, or the handle may be directly pivoted to the bar.

As shown, a first end portion 48 of the handle 46 is pivotally engaged with the bracket 42. The pivotal engagement may be made via a pin 50 located through the bracket 42 and the first end portion 48 of the handle 46 when the handle is located between the two upstanding portions 44 of the bracket 42. The handle 46, in one position, extends along the upper surface 16 toward the first end portion 22 of the first bar 12.

A second end portion 52 of the handle 46 may be grooved to facilitate receiving human fingers in grooves 54. The grooves 54 may assist a human hand in firmly grasping the handle 46 as well as providing a comfortable feeling to the hand.

Additionally, or alternatively, the second end portion 52 of the handle 46 may have a material located thereon. The material 56 may be used to facilitate a human hand to grasp the handle 46. The material 56 may be tape and/or a polymer applied to the second end portion 52, such as by dipping or coating.

While a handle 46 that is substantially linear is depicted in the figures, the handle 46 may be curved. Locating one or more curves in the handle 46, such as a curve that bows the handle 46 away from the upper surface 16, facilitates one being able to wrap one's fingers around the handle 46 and those fingers not being caught between the handle 46 and the first bar 12 when the handle 46 is located adjacent the upper surface 16 of the first bar 12, as can be appreciated from FIG. 1.

A link 66, which in this embodiment is a curvilinear member, has a first end portion 64 that is pivotally attached directly to the handle 46 without the need for a bracket. In this case, a pin 68 is located through both the link 66 and the handle 46 to permit them to move with respect to one another.

The link 66 has a second end portion 70 that is pivotally attached to the second bar 14. The second bar 14 may have an upper surface 72, a bottom surface 74, two side surfaces 76, a first end portion 80 and a second end portion 78. A bracket 82 may be fixedly secured to the upper surface 72 adjacent or in the second end portion 78 of the second bar 14. The bracket 82 may have two upstanding portions 84 for receiving therebetween the second end portion 70 of the link 64. A pin 86 may be located through the upstanding portions 84 and the link 64 to permit the link 64 to pivot with respect to the bracket 82.

A second counter-stop 88 may be located adjacent or in the second end portion 78 of the second bar 14. Preferably, the second counter-stop 88 is fixedly secured adjacent or in the second end portion 78 of the second bar 14. The second counter-stop 88 depends downwardly adjacent or in the second end portion 78 beyond the bottom surface 74 of the second bar 14. The second counter-stop 88 may be substantially rectangular in shape, with at least an inwardly facing surface 90 being substantially planar. The second counter-stop 88 may be fixedly secured adjacent or in the second end portion 78 of the second bar 14 by any means including, but not limited to, welding, mechanical fasteners and/or adhesive.

A first counter-stop 92 is fixedly attached adjacent or in the first end portion 80 of the second bar 14. The first counter-stop 92 preferably has a substantially planar outwardly facing surface 94. The outwardly facing surface 94 may be supported in any manner, including a ramp-like structure as depicted in the figures. The first counter-stop 92 may be fixedly attached adjacent or in the first end portion 80 by any means including, but not limited to, mechanical fasteners, welding and/or adhesive. FIGS. 1 and 2 illustrate the first counter-stop 92 being secured to the second bar 14 with mechanical fasteners, such as screws.

It is within the scope of the present invention to locate several apertures (not shown) at predetermined intervals in the bottom surface 74 of the second bar 14 adjacent or in the second end portion 80 of the bar 14. The apertures permit the first counter-stop 92 to be located at more than one location along or in the first end portion 80 of the bar 14.

The first bar 12 and second bar 14 may both be said to be elongated, with both extending generally along the same longitudinal axis. The first bar 12 and second bar 14 are interconnected with each other such that they are movable longitudinally or axially with respect to each other. This may be accomplished in multiple ways, including by having channels or other features for mutual engagement, while still allowing relative longitudinal movement. In the illustrated embodiment, the second bar 14 is located within the hollow interior 30 of the first bar 12 and axial movement of the second bar 14 within the first bar 12 is permitted. The first counter-stop 92 on the second bar 14 extends through the window 38 in the bottom surface 20 of the first bar 12.

The first bar 12, the second bar 14, the stops 26, 32, the counter-stops 88, 92, the brackets 42, 82, the handle 46 and the curvilinear member 66 are preferably constructed of a rigid material or materials. For example, the above listed items may be constructed of metal, such as aluminum, steel or iron.

Other materials, such as composite materials, ceramics and/or plastics are also within the scope of the present invention.

To use the holder 10, a truss, joist or wall stud, collectively referred to as a first framing member 96, is located between the first stop 26 on the first bar 12 and the first counter-stop 92 on the second bar 14 or the second stop 32 on the first bar 12 and the second counter-stop 88 on the second bar 14. For example, if the first framing member 96 is located between the first stop 26 on the first bar 12 and the first counter-stop 92 on the second bar 14, a second framing member 98 (comprised of a truss, joist or wall stud) is located between the second stop 32 on the first bar 12 and the second counter-stop 88 on the second bar 14. Hereinafter, the term "first jaw" 100, will be used to describe the first stop 26 on the first bar 12 and the first counter-stop 92 on the second bar 14 and the term "second jaw" 102, will be used to describe the second stop 32 on the first bar 12 and the second counter-stop 88 on the second bar 14. It can be appreciated that the second jaw 102, with the adjustable position of the second counter-stop 88, can accommodate framing members 98 of many widths. Alternatively, the position of the second counter-stop 88 may be fixed.

To facilitate locating the framing members 96, 98 in the jaws 100, 102, the handle 46 is rotated upwardly to an open position, as shown in FIG. 2. Rotation of the handle 46 in the upward direction, pushes the link 66 away from the first bar 12 and causes the second counter-stop 88, on the second bar 14 to move axially away from the second stop 32 on the first bar 12 and, simultaneously, for the first counter-stop 92 on the second bar 14 to move axially away from the first stop 26 on the first bar 12. Moving the handle from the upwardly raised open position of FIG. 2 to the closed position of FIG. 1 moves the jaws 100 and 102 from an open position to a closed position. In the closed position, the jaws are spaced apart by a distance that causes them to grip the framing members.

According to embodiments of the present invention, a holder of the present invention sets members such as trusses, floor joists, rafters and wall studs on centers, such as 16 and 24" centers. For example, an inventive tool is used to hold and stabilize trusses while they are being nailed to other members. According to embodiments of the present invention, an inventive holder sets members of various sizes such as a 1½", 2", 3", or 3½" side of a member. In some embodiments, the distance between the inwardly facing surface 28 on the first stop and the outwardly facing surface 34 on the second stop is 16 inches, and in another it is 24 inches.

Figure 3:
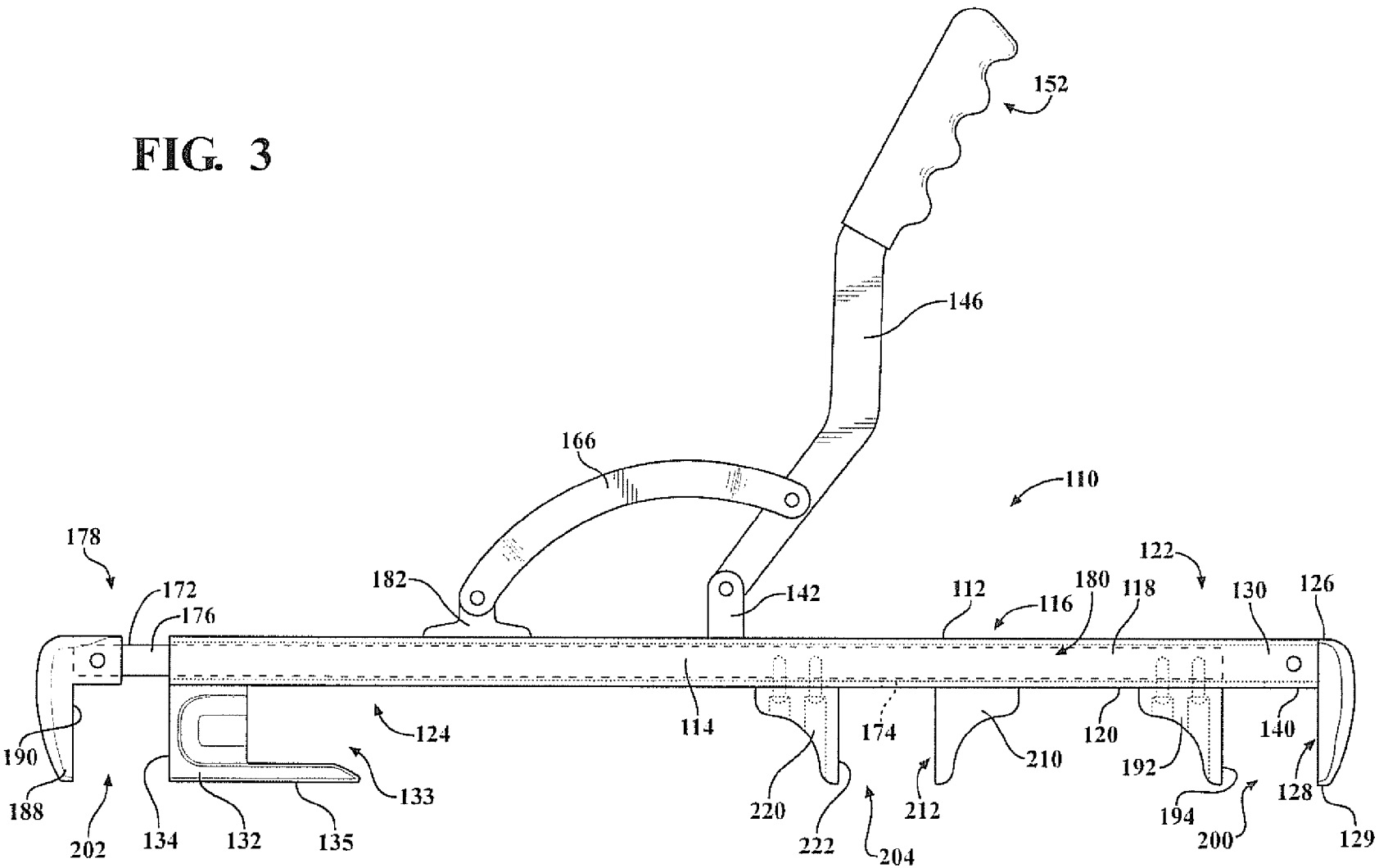
FIG. 3 is a side view of another embodiment of a holder where a handle portion of the holder is in a raised or open position.
Figure 4:
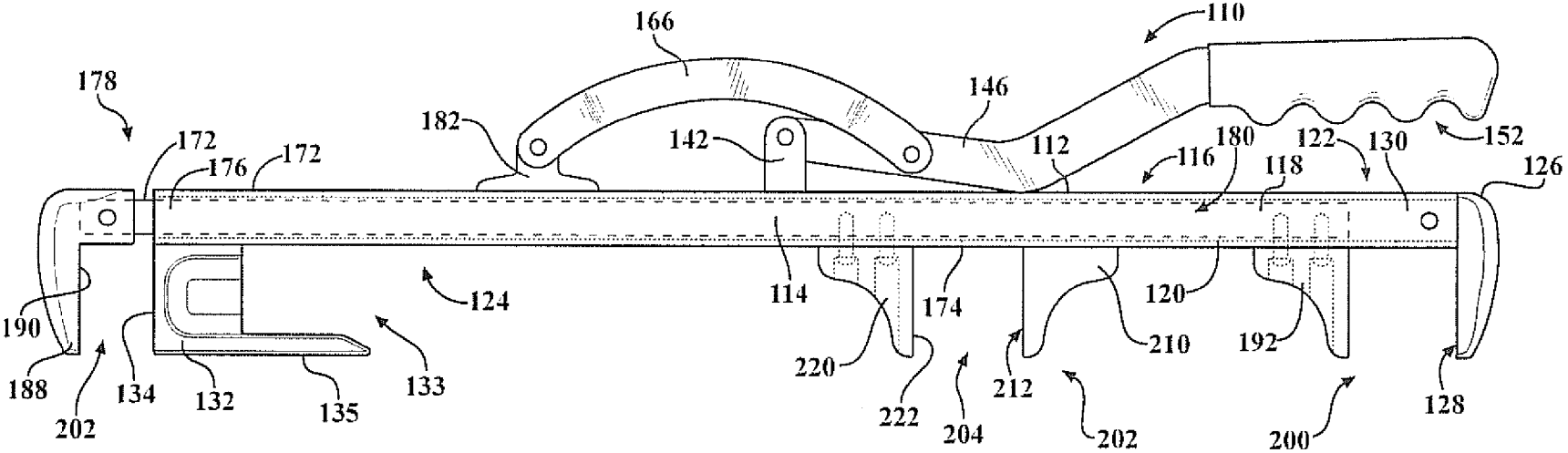
FIG. 4 is a side view of the embodiment of FIG. 3 with the handle portion in a lowered or closed position.

Referring now to FIGS. 3 and 4, a second embodiment of a holder or tool according to the present invention is shown at 110. This embodiment is conceptually similar to the first embodiment, but has a different linkage design for moving the bars and includes a third stop and a third counter-stop defining a third jaw.

The holder 110 includes a first bar 112 and a second bar 114 that are slidably interconnected for relative axial or longitudinal movement. As with the first embodiment, the second bar 114 is slidably received in a hollow interior 130 of the first bar 112. The first bar 112 has an upper surface 116, side surfaces 118 and a bottom surface 120. A first stop 126 is interconnected with the first bar 112 at the first end portion 122 and extends downwardly past the bottom surface 120. A second stop 132 is interconnected with a second end portion 124 of the first bar and extends downwardly beyond the bottom surface 120. In this embodiment, the second stop 132 also defines a hook 133 for hanging the tool such as on a framing member. The second stop has a bottom surface 135 that lies generally in a plane with the lowermost point of at least some of the other stops or counterstops, such as the bottom 129 of the first stop 126. The first stop 126 has an inwardly facing surface 128 and the second stop 132 has an outwardly facing surface 134. Unlike the first embodiment, a third stop 210 is interconnected with the first bar between the first end portion 122 and second end portion 124. The third stop 210 has a surface 212 that is directed generally towards the second end portion 124.

The second bar 114 has a first end portion 180 and a second end portion 178. A first counter-stop 192 is interconnected with the first end portion 180 and a second counter-stop 188 is interconnected with the second end portion. Both extend downwardly past a bottom surface 174 of the second bar 114. The first counter-stop 192 has an outwardly facing surface 194 and the second counter stop has an inwardly facing surface 190. A third counter-stop 220 is interconnected with the second bar 114 between the first end portion 180 and second end portion 178, and has a surface 222 that faces the surface 212 of the third stop 210. Together, the first stop 126 and first counter-stop define a first jaw 200, the second stop 132 and second counter-stop 188 define a second jaw, and the third stop 210 and third counter stop 220 define a third jaw, all of which move in unison when the mechanism, defined by handle 146 and link 166, moves between an open and closed position.

As shown, the mechanism for moving the bars relative to each other in this embodiment differs from the first embodiment. The handle 146 is pivoted to the first bar 114 more centrally and is shaped such that the outer end 152 is spaced from the bar 114 when in the closed position of FIG. 4. This makes it easier for a user to grip the handle and operate the mechanism. In this embodiment, a bracket 142 is connected to the first bar and the handle is pivotally interconnected with the bracket. The link 166 is pivotally interconnected with the handle 146 at one of its ends and is pivotally interconnected with the second bar 114 at its other end. In this embodiment, a bracket 182 is connected to the second bar and the link 166 is pivoted to the bracket. The bracket may extend upwardly from the second bar 114 through a window, not shown, in the first bar. As will be clear to those of skill in the art, the mechanism for moving the bars relative to each other may be formed differently than shown. As an example, the handle may be pivoted to the second bar with the link interconnecting the handle and the first bar. As a further alternative, the mechanism may be a different linkage design, or a different mechanism operable to move the links relative to each other. However, the use of a handle and a link is preferred. Referring to FIG. 4, it can be seen that the handle is in an over-center position when in the closed position. That is, if a line were drawn between the pivot interconnecting the link 166 with the bracket 182 and the pivot interconnecting the handle 146 with the bracket 142, then the pivot between the link 166 and handle 146 would be below this line when the handle is in the position of FIG. 4. This locks the mechanism in the closed position until the handle is pulled out of the over-center position.

The embodiment of FIGS. 3 and 4 provides the advantage that a single tool may be used to space and hold framing members at two different distances. In one version, the distance between surface 190 and surface 222 is approximately 16 inches and the distance between surface 190 and surface 194 is 24 inches. This allows the tool to be used to position framing members at 16 or 24 inches on center.

Figure 5:
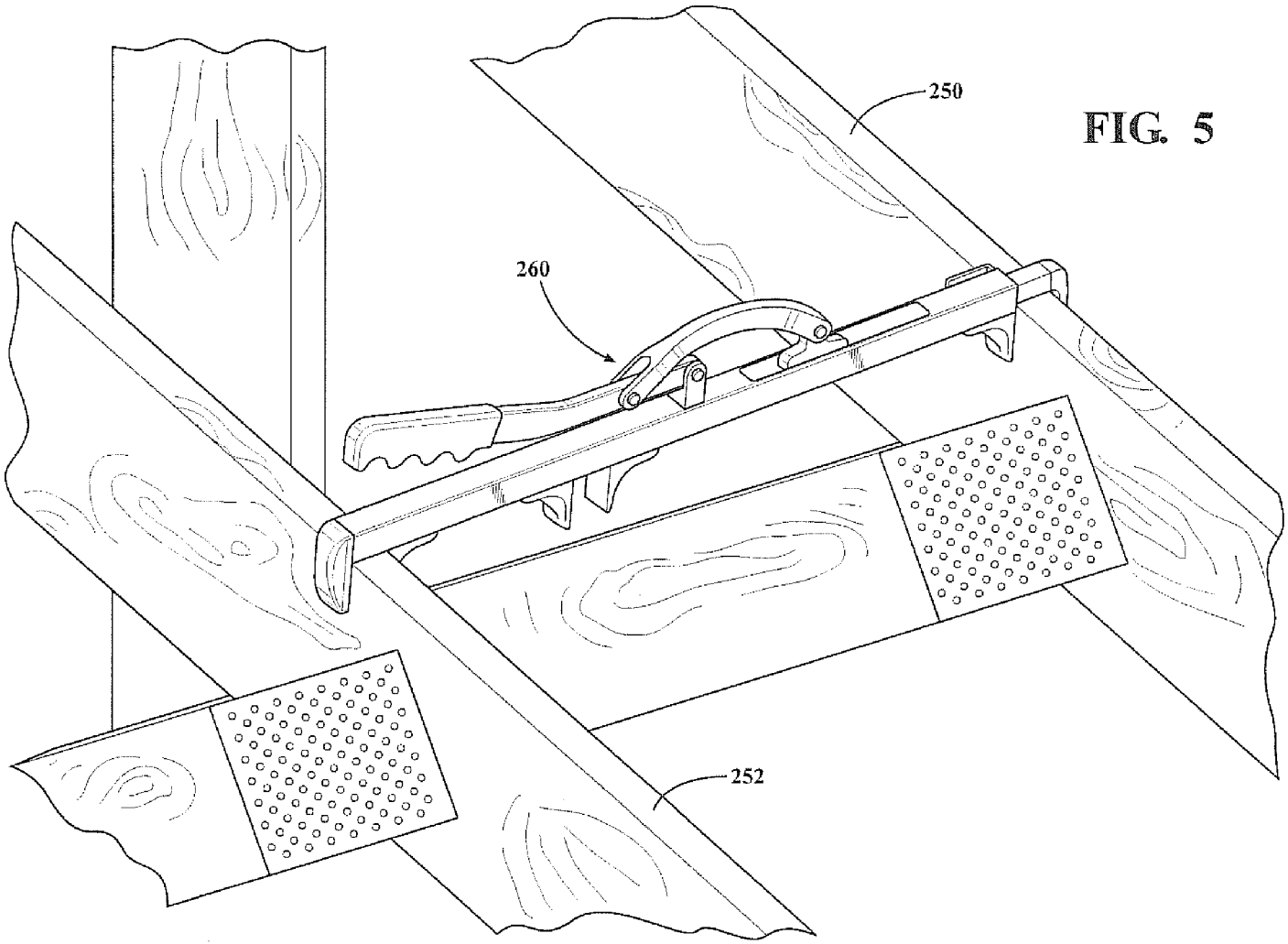
FIG. 5 is an environmental view of an embodiment of a holder showing an example use.

FIG. 5 provides a view of an exemplary embodiment of the present invention in use. A first truss 250 and a second truss 252 are being installed and the tool 260 is being used to hold them at a desired relative spacing. Multiple tools may be used to position one or more trusses until they are more permanently fastened to other framing members.

The invention claimed is:

1. A tool for spacing and holding a first framing member relative to a second framing member at a predetermined distance, the tool comprising:

an elongated first bar having a first end portion and an opposed second end portion, the first bar having a bottom surface and an opposed upper surface;

a first stop interconnected with the first end portion of the first bar and extending downwardly beyond the bottom surface of the first bar, the first stop having an inwardly facing surface;

a second stop interconnected with the second end portion of the first bar and extending downwardly beyond the bottom surface of the first bar, the second stop having an outwardly facing surface;

an elongated second bar having a first end portion and an opposed second end portion, the second bar having a bottom surface and an opposed upper surface;

a first counter-stop interconnected with the first end portion of the second bar and extending downwardly beyond the bottom surface of the second bar, the first counter stop having an outwardly facing surface;

a second counter-stop interconnected with the second end portion of the second bar and extending downwardly beyond the bottom surface of the second bar, the second counter-stop having an inwardly facing surface;

the first bar and the second bar being slidably interconnected such that the second bar is longitudinally movable with respect to the first bar and such that the inwardly facing surface of the first stop is directed toward and spaced from the outwardly facing surface of the first counter-stop and the outwardly facing surface of the second stop is directed toward and spaced from the inwardly facing surface of the second counter-stop, the first stop and the first counter-stop defining a first jaw and the second stop and second counter-stop defining a second jaw, the first jaw and the second jaw each having an open position and a closed position, the stops and corresponding counter-stops being spaced further apart in the open position than in the closed position; and a mechanism for moving the second bar relative to the first bar, the mechanism including a handle that is pivotally interconnected with one of the bars and a link having a first end pivotally interconnected with the handle and a second end pivotally interconnected with the other of the bars;

wherein movement of the handle from an open position to a closed position moves the first and second jaws from the open position to the closed position.

2. The tool in accordance with claim 1, wherein the first bar is at least partially hollow and the second bar is slidably received in the first bar.

3. The tool in accordance with claim 2, wherein the first bar has at least one window defined in the bottom surface thereof, the first counter-stop extending through the window.

4. The tool in accordance with claim 1, further comprising:

a third stop interconnected with the first bar between the first and second stops, the third stop extending downwardly beyond the bottom surface of the first bar and having a surface;

a third counter-stop interconnected with the second bar between the first and second counter-stops, the third counter-stop extending downwardly beyond the bottom surface of the second bar and having a surface;

the third stop and the third counter-stop defining a third jaw, the surface of the third stop directed toward and spaced from the surface of the third counter-stop, the third jaw having an open position and a closed position; and movement of the handle from the open position to the closed position further moving the third jaw from the open position to the closed position.

5. The tool in accordance with claim 1, wherein the handle in the closed position extends along the bars.

6. The tool in accordance with claim 5, wherein the handle is formed such that a second end portion of the handle is spaced away from the first and second bar when the handle is in the closed position.

7. The tool in accordance with claim 1, wherein the mechanism is configured such that the handle is in an over-center position when in the closed position.

8. The tool in accordance with claim 1, wherein when the jaws are in the closed position, the stops and corresponding counter-stops being spaced apart by approximately the thickness of a framing member.

9. The tool in accordance with claim 8, wherein the stops and corresponding counter-stops are spaced apart by approximately 1.5 inches when the jaws are in the closed position.

10. A tool for spacing and holding a first framing member relative to a second framing member at a predetermined distance, the tool comprising:

an elongated first bar having a first end portion and an opposed second end portion, the first bar having a bottom surface and an opposed upper surface;

a first stop interconnected with the first end portion of the first bar and extending downwardly beyond the bottom surface of the first bar, the first stop having an inwardly facing surface;

a second stop interconnected with the second end portion of the first bar and extending downwardly beyond the bottom surface of the first bar, the second stop having an outwardly facing surface;

a third stop interconnected with the first bar between the first and second stops, the third stop extending downwardly beyond the bottom surface of the first bar and having a surface;

an elongated second bar having a first end portion and an opposed second end portion, the second bar having a bottom surface and an opposed upper surface;

a first counter-stop interconnected with the first end portion of the second bar and extending downwardly beyond the bottom surface of the second bar, the first counter stop having an outwardly facing surface;

a second counter-stop interconnected with the second end portion of the second bar and extending downwardly beyond the bottom surface of the second bar, the second counter-stop having an inwardly facing surface;

a third counter-stop interconnected with the second bar between the first and second counter-stops, the third counter-stop extending downwardly beyond the bottom surface of the second bar and having a surface;

the first bar and the second bar being slidably interconnected such that the second bar is longitudinally movable with respect to the first bar and such that the inwardly facing surface of the first stop is directed toward and spaced from the outwardly facing surface of the first counter-stop and the outwardly facing surface of the second stop is directed toward and spaced from the inwardly facing surface of the second counter-stop and the surface of the third stop is directed toward and spaced from the surface of the third counter-stop, the first stop and the first counter-stop defining a first jaw, the second stop and second counter-stop defining a second jaw, the third stop and the third counter-stop defining a third jaw, the first, second and third jaws each having an open position and a closed position, the stops and corresponding counter-stops being spaced further apart in the open position than in the closed position; and a mechanism for moving the second bar relative to the first bar such that the first, second and third jaws are moved simultaneously between the open and closed positions, the mechanism including a handle that is pivotally interconnected with one of the bars and a link having a first end pivotally interconnected with the handle and a second end pivotally interconnected with the other of the bars;

wherein movement of the handle from an open position to a closed position moves the first and second jaws from the open position to the closed position.

* * * * *